United States Patent [19]

Ragano et al.

[11] 4,013,994

[45] Mar. 22, 1977

[54] VEHICLE WARNING SYSTEM

[76] Inventors: Anthony Ragano, 806 S. Westshore Blvd., Tampa, Fla. 33609; Steven A. Barton, 3315 31st Ave. North, Apt. 215, St. Petersburg, Fla. 33713

[22] Filed: Dec. 5, 1974

[21] Appl. No.: 529,815

[52] U.S. Cl. ..... 340/33; 340/224; 325/64

[51] Int. Cl.[2] ..... G08B 3/10

[58] Field of Search ..... 340/31 R, 32, 33, 34, 340/224, 416; 325/64, 65, 29, 364; 343/225, 228

[56] References Cited

UNITED STATES PATENTS

| | | | |
|---|---|---|---|
| 3,673,560 | 6/1972 | Barsh et al. | 340/33 |
| 3,760,349 | 9/1973 | Keister et al. | 340/33 |

*Primary Examiner*—Alvin H. Waring
*Attorney, Agent, or Firm*—Arthur W. Fisher, III

[57] ABSTRACT

A vehicular warning system designed for use in combination with a remote transmitter means to provide a positive warning signal when the relative distance therebetween reaches a predetermined minimum range. The vehicular warning system comprises a receiver means to receive incoming signals and decoder means to selectively filter preselected signals from the remote transmitter. The preselected signals are fed to a control means which generates a control signal when the preselected signals reach a predetermined threshold reference and a warning means actuated upon receipt of the control signals.

11 Claims, 2 Drawing Figures

VEHICLE WARNING SYSTEM

BACKGROUND OF THE INVENTION

1. Field of the Invention

This invention relates to a vehicular warning system including a receiver means designed for use in combination with a remote transmitter means to provide a positive warning signal when the relative distance therebetween reaches a predetermined minimum range.

2. Description of the Prior Art

With the introduction of the automobile as an integral part in our daily lives, there has been an extraordinary increase in number of law enforcement and emergency vehicles such as ambulances and fire-fighting equipment. Quite often the operation of such law enforcement and emergency vehicles require high speed and emergency performance which might endanger other automotive vehicles. Thus, various schemes of sirens, horns and flashing/oscillating lights have been devised to warn the general traffic of the proximity of such vehicles and to therefore govern their actions accordingly. In addition, expensive, complicated train crossing warning devices have been used with limited success to warn drivers of the approach of trains in relationship to such crossings.

The effectiveness of such sirens, horns, and flashing-/oscillating lights and other warning signals have become increasingly less effective in view of the proliferation of radios and air-conditioning in almost every car. In addition, the vastly increased congestion and increase in relative speeds in normal operations has increased the accidents between the general traffic and such emergency and law enforcement vehicles in performance of their duties.

Further, these same problems have greatly increased the number of accidents resulting between trains and cars at train crossings.

Despite attempts that have been made to overcome these problems, there remains a need for a simple, inexpensive yet operation of effective warning device to warn the public at large of the proximity of such vehicles in order that they may be acted accordingly and avoid unnecessary accidents.

SUMMARY OF THE INVENTION

The present invention relates to a vehicular warning system designed for use in combination with a remote transmitter to provide a positive warning signal when the relative distance therebetween reaches a predetermined minimum range. More specifically, the vehicular warning system comprises a receiver means to receive incoming signals and a decoder means to selectively decode preselected signals from the remote transmitter. The preselected signals are then fed to a control means which generates a trigger output signal when the preselected signals reach a predetermined threshold reference and a warning means actuated upon receipt of the trigger output signals. The vehicular warning system is configured to be installed in automobiles, trucks and the like while the remote transmitter is installed in various emergency vehicles, trains and the like.

The receiver means comprises a receiver in combination with antenna means and amplifier to receive and amplify the the incoming signals from the remote transmitter. The incoming signals are then fed to the decoder means which comprises a selective filter to filter incoming signals of a predetermined frequency and an audio amplifier means to amplity the filtered incoming signals. The amplified filtered signals are then fed to the rectifier means comprising a fullwave rectifier bridge to generate a direct current trigger control signal which is fed directly to the control means.

The control means comprises a first and second comparator means arranged in parallel to receive the trigger control signal from the rectifier means simultaneously. Thus, the first and second comparator means compare the DC trigger control signal with a first and second predetermined threshold reference respectively and generate a first and second trigger output signal respectively in response thereto. The first and second circuit comparator means further include a first and second switch means respectively to selectively isolate and electrically couple the first and second comparator means to the warning means as more fully described hereinafter.

The warning means comprises a first and second warning device electrically coupled to the first and second comparator means respectively through the first and second switch means respectively. The first warning device comprises a visual lamp means while the second warning device comprises an audio oscillator/speaker means.

As previously described, normally the remote transmitter is located on an emergency vehicle, train or the like. With the remote transmitter transmitting, the incoming signals are fed through the receiver means to the decoder means where the incoming signals of predetermined frequency will be filtered and fed to the rectifier means.

Initially, the distance between the vehicles will be such that the DC trigger control signals will be less than either of the two predetermined threshold references of the first and second comparator means respectively. As the emergency vehicle approaches the vehicle the DC level of the trigger control signal will exceed the first preselected threshold reference of the first comparator means causing the first comparator means to generate a first trigger output signal actuating the first switch means to the second state thereby generating the first or visual lamp warning. As the vehicles continue to approach the DC level of the trigger control signal will equal or exceed the second predetermined threshold reference of the second comparator means generating the second trigger output signal actuating the second switch means to be second state thereby actuating the audio oscillator and speaker of the second warning device providing both a visual and audio indicating when the vehicles reach the second or less of the two predetermined ranges.

Thus, a simple but effective warning system is provided between the private or personal vehicle and the emergency or law enforcement vehicle notwithstanding closed windows with the automobile air-conditioning, radios, tapes and other distractions.

This invention accordingly comprises the features of construction, combination of elements, and arrangement of parts which will be exemplified in the construction hereinafter set forth and the scope of the invention will be indicated in the claims.

BRIEF DESCRIPTION OF THE DRAWINGS

For a fuller understanding of the nature and the objects of the invention, reference should be had to the following detailed description taken in connection with the accompanying drawing, in which.

Similar reference characters refer to similar parts throughout the several views of the drawing.

DETAILED DESCRIPTION OF THE PREFERRED EMBODIMENT

Figures 1, 2:
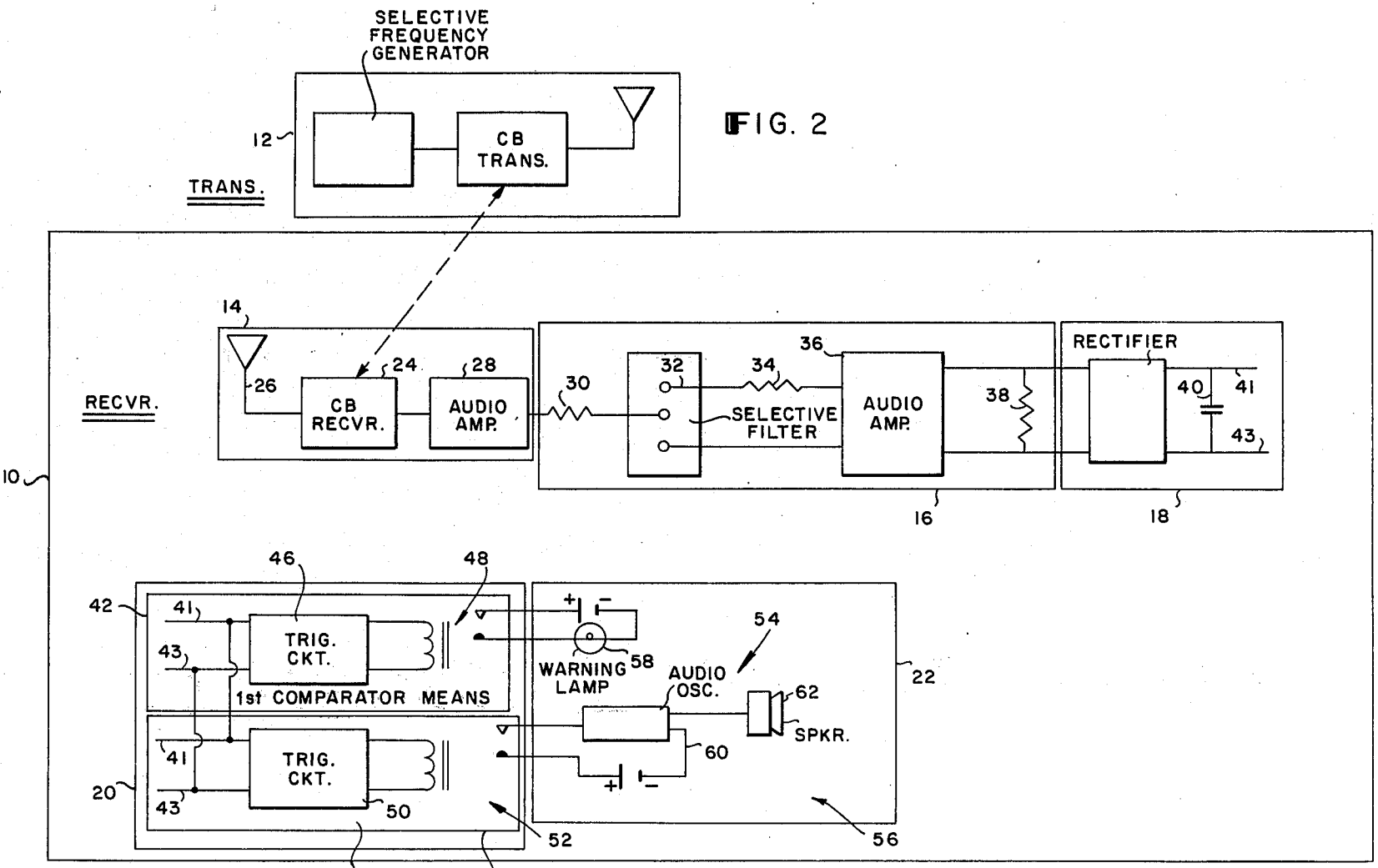
FIG. 1 is a schematic of the vehicle warning system.
FIG. 2 is a schematic of a transmitter.

As shown in FIG. 1, the present invention comprises a vehicular warning system generally indicated as 10. As depicted, the vehicular warning system 10 is designed for use in combination with a remote transmitter generally indicated as 12 to provide a positive warning signal when the relative distance therebetween reaches a predetermined minimum range as more fully described hereinafter.

As shown, the vehicular warning system 10 comprises a receiver means 14, decoder means 16, rectifier means 18, control means 20 and warning means 22 operatively integrated into the overall vehicular warning system 10 as more fully described hereinafter. The vehicular warning 10 is configured to be installed in automobiles trucks as the like while the remote transmitter is installed in various emergency vehicles, trains and the like.

The receiver means 14 shown comprises a citizen's band receiver 24 compatible with the remote transmitter 12, antenna means 26 and audio amplifier means 28 to receive and amplify the incoming signals from the remote transmitter 12. Of course, any compatible transmitter/receiver combination would be suitable.

The decoder means 16 comprises impedance 30, selective filter 32, impedance 34, audio amplifier 36 and impedance 38. The incoming signals are fed from the receiver 24 to the decoder means 16 which filters and amplifies incoming signals of a predetermined frequency.

The rectifier means 18 comprises a full wave rectifier bridge and impedance 40. The amplified filtered signals are fed from the decoder means 16 to the rectifier means which generates a direct current trigger control signal which is fed directly to the control means.

The control means 20 comprises a first and second comparator means 42 and 44 respectively arranged in parallel to receive the trigger control signal from the rectifier means 18 simultaneously through conductors 41 and 43. The first comparator means 42 comprises a first comparator circuit 46 and a first switch means 48 while the second comparator means 44 comprises a second comparator circuit 50 and a second switch means 52. The first and second comparator means 42 and 44 each include circuity to compare the DC level of trigger control signal with a first and second predetermined threshold reference respectively and generate a first and second trigger output signal respectively in response thereto. As depicted, the first and second switch means 48 and 52 each comprise relay means coupled to the first and second comparator circuits 46 and 50 respectively to receive the first and second trigger output signals respectively. The first and second switch means 48 and 52 respectively selectively isolate and electrically couple the first and second comparator circuits 46 and 50 to the warning means as more fully described hereinafter.

The warning means 22 comprises a first and second warning device 54 and 56 respectively electrically coupled to the first and second comparator means 42 and 44 respectively through the first and second switch means 48 and 52 respectively. The first warning device 54 comprises a visual lamp means 58 while the second warning device 56 comprises an audio oscillator 60/speaker 62.

As previously described, normally the remote transmitter 12 is located on an emergency vehicle, train or the like (not shown). With the remote transmitter 12 transmitting, the incoming signals are fed through the receiver means 14 to the decoder means 16 where the incoming signals of predetermined frequency will be filtered and fed to the rectifier means 18.

Initially, the distance between the vehicles (not shown) will be such that the DC trigger control signals will be less than either of the two predetermined threshold references of the first and second comparator means 42 and 44 respectively. As the emergency vehicle (not shown) approaches the vehicle (not shown), the DC level of the trigger control signal will exceed the first preselected threshold reference of the first comparator means 42 causing the first comparator means 42 to generate a first trigger output signal actuating the first switch means 48 to the second state thereby generating the first or visual lamp warning. As the vehicles (not shown) continue to approach each other, the DC level of the trigger control signal will equal and exceed the second predetermined threshold reference of the second comparator means 44 generating the second trigger output signal actuating the second switch means 52 to the second state thereby actuating the audio oscillator 60 and speaker 62 of the second warning device 56 providing both a visual and audio indicating when the vehicles (not shown) reach the second or less of the two predetermined ranges.

Thus, a simple but effective warning system is provided between the private or personal vehicle and the emergency or law enforcement vehicle notwithstanding closed windows with the automobile air conditioning, radios, tapes and other distractions.

It will, thus be seen that the objects made apparent from the preceding description are efficiently attained and, since certain changes may be made in the above construction without departing from the scope of the invention, it is intended that all matter contained in the above description or shown in the accompanying drawings shall be interpreted as illustrative and not in a limiting sense.

What is claimed is:

1. A vehicular warning system for use in combination with a remote transmitter to provide a positive warning signal when the relative distance therebetween reaches a predetermined minimum range, said vehicular warning system comprises a receiver means including circuitry to receive incoming signals from the remote transmitter, a decoder means coupled to said receiver means to receive said incoming signals therefrom, said decoder means including circuitry to decode said incoming signals of a predetermined wave form and generate decoder output signals in response thereto, a rectifier means coupled to said decoder means to receive said decoder output signals therefrom, said rectified means including circuitry to rectify said output signals and generate trigger control signals in response thereto, a control means coupled to said rectifier means to receive said trigger control signals therefrom, said control means including a first comparator means having circuitry to compare said trigger control signals with a first predetermined threshold reference and generate first trigger output signals when said trigger control signals exceed said first predetermined threshold reference and a first switch means coupled to said first comparator means to receive said trigger output signals therefrom, and a warning means coupled to said control means, said first switch means having a first and second state, said first switch means being in said first state when said trigger control signals are less than said first predetermined threshold reference and in said second state when said trigger control signals are greater than said first predetermined threshold reference, said first comparator means being isolated from said warning means when said first switch means is in said first state, and coupled to said warning means when said first switch means is in said second state, said warning means including a first warning device to receive said first trigger output signals when said first switch means is in said second state, said first warning device including circuitry to generate a first warning signal in response to said first trigger output signal; said control means further includes a second comparator means having circuitry to compare said trigger control signals with a second predetermined threshold reference and generate a second trigger output signal when said trigger control signal exceeds said second predetermined threshold reference and a second switch means coupled to said second comparator means to receive said second trigger output signals therefrom, said second predetermined threshold reference being greater than said first predetermined threshold reference, and wherein said warning means further includes a second switch means including a first and second state, said second switch means being in said first state said trigger control signals are less than said second predetermined threshold reference and in said second state when said trigger control signals are greater than said second predetermined threshold reference, said second comparator means being isolated from said warning means when said second switch means is in said first state and coupled to said warning means when said second switch means is in said second state, said warning means further including a second warning device to receive said second trigger output signals when said second switch means is in said second position said second warning including circuitry to generate a second warning signal in response to said second trigger output signals.

2. The vehicular warning system of claim 1 wherein said first and second comparator means are coupled in parallel to said rectifier means.

3. The vehicular warning system of claim 1 wherein said receiver means further includes amplifier means coupled to said receiver to amplify said incoming signals.

4. The vehicular warning system of claim 1 wherein said decoder means includes a selective filter to decode said incoming signals of a predetermined.

5. The vehicular warning system of claim 4 wherein said decoder means further includes amplifier means to amplify said decoded incoming signals.

6. The vehicular warning system of claim 1 wherein said rectifier means comprises a full-wave recitfier bridge to generate a direct current trigger control signals in response to said decoded incoming signals.

7. The vehicular warning systems of claim 6 wherein said rectifier means further includes impedance means coupled across said full-wave rectifier bridge.

8. The vehicular warning system of claim 1 wherein said first and second switch means each comprises relay means.

9. The vehicular warning system of claim 1 wherein said first warning device comprises lamp means to provide a visual indication of the predetermined relative distance between said vehicular warning system and the remote transmitter.

10. The vehicular warning system of claim 1 wherein said second warning device comprises a speaker means to provide an audio warning signal of the predetermined relative distance between said vehicular warning system and the remote transmitter.

11. The vehicular warning system of claim 1 wherein said second warning device further includes an audio oscillator between said second switch means and said speaker means to generate said second warning signal.

* * * * *